US006305206B1

(12) United States Patent
Kobayashi

(10) Patent No.: US 6,305,206 B1
(45) Date of Patent: Oct. 23, 2001

(54) REVERSIBLE ROLLING METHOD AND REVERSIBLE ROLLING SYSTEM

(75) Inventor: Yujirou Kobayashi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/551,602

(22) Filed: Apr. 17, 2000

(30) Foreign Application Priority Data

Sep. 3, 1999 (JP) ..... 11-2499929

(51) Int. Cl.[7] ..... B21B 41/06

(52) U.S. Cl. ..... 72/229; 72/9.2; 72/11.8; 72/365.2

(58) Field of Search ..... 72/8.3, 8.9, 9.2, 72/11.1, 11.6, 11.8, 12.7, 12.8, 229, 365.2

(56) References Cited

FOREIGN PATENT DOCUMENTS

| | | | | |
|---|---|---|---|---|
| 51-72951 | | 6/1976 | (JP) . | |
| 58-151905 | * | 9/1983 | (JP) | 72/229 |
| 1-150411 | * | 6/1989 | (JP) | 72/11.8 |
| 2-11205 | * | 1/1990 | (JP) | 72/229 |
| 2-224811 | * | 9/1990 | (JP) | 72/229 |
| 6-262225 | | 9/1994 | (JP) . | |
| 6-285524 | * | 10/1994 | (JP) | 72/9.2 |
| 7-232205 | | 9/1995 | (JP) . | |

* cited by examiner

*Primary Examiner*—Ed Tolan
(74) *Attorney, Agent, or Firm*—Crowell & Moring LLP

(57) ABSTRACT

A pass schedule calculation apparatus calculates pass schedule and inputs the schedule to a preset apparatus which is plate thickness control means. The present apparatus controls a draft motor before rolling to set an appropriate initial roll clearance, and instructs a control target value to a plate thickness control apparatus and rolling speed control apparatus to perform control. A method of determining the pass schedule comprises: obtaining a product of a function which includes a pass rolling parameter and has a correlation of monotonic increase with respect to each pass draft amount, and another function including a rolling parameter which increases with the number of passes; using the product of the functions as a function substantially independent of a rolling speed; solving optimization problem of the parameter for equalizing the function value in the respective passes to calculate each pass draft amount; and using the draft amount as a draft schedule to determine the rolling pass schedule.

18 Claims, 2 Drawing Sheets

REVERSIBLE ROLLING METHOD AND REVERSIBLE ROLLING SYSTEM

BACKGROUND OF THE INVENTION (i) Field of the Invention

The present invention relates to a reversible rolling method in which an optimum rolling pass schedule is rationally determined with respect to a reversible rolling system for mainly rolling a steel strip and rolling is performed, and a reversible rolling system for performing the rolling on the basis of the rolling pass schedule.

(ii) Description of the Related Art

In a reversible rolling system, provided with one rolling mill (a pair of combined rolling mills as occasion demands), for repeatedly reciprocating and passing one steel strip forward and backward in the rolling mill to advance the rolling at every pass, it is necessary to determine a draft schedule is set which determines a draft amount for each pass until a target plate thickness is finally obtained, and a rolling pass schedule for satisfying various conditions on the basis of the draft schedule.

As a method of determining the pass schedule of the reversible rolling system, techniques have heretofore been disclosed, for example, in JP-A-6-262225, JP-A-7-232205 and the like. An object of these inventions is to provide a method of setting the pass schedule to maximize the production amount.

The basic idea of the invention disclosed in JP-A-6-262225 comprises: preparing a draft amount table beforehand; and setting the rolling speed of each pass on the basis of the table so as to reach the upper limit of the thermal overload of a motor or a power supply.

The basic idea of the invention disclosed in JP-A-7-232205 comprises:

1. setting the draft ratio of each pass to be maximum on the basis of restrictive draft conditions such as a load, and setting the rolling speed at the maximum speed which is allowable from restrictive speed conditions such as a power; or
2. determining the maximum speed on the basis of the restrictive conditions, and setting the draft ratio of each pass under the conditions.

Moreover, a method of determining the pass schedule for the purpose of obtaining a high plate thickness precision in the reversible rolling system is also proposed in JP-A-51-72951. The basic idea comprises: dividing and storing the actually detected data of a plate thickness into two groups comprising the data during the rolling in a forward path and the data during the rolling in a backward path; obtaining estimated values independently of each other on the basis of the stored data in the respective groups; and gradually eliminating a difference from a theoretical value to perform adapted correction.

The invention of JP-6-262225 has a problem that the draft amount table is first required, but the method of preparing the table is not disclosed, and the table needs to be prepared by knowledge on the basis of experiences.

In this respect, in JP-A-7-232205, the method of preparing the draft schedule is proposed, and one effective method is proposed in setting the draft schedule for obtaining the maximum production amount. In the schedule set as described above, the rolling is regulated by various restrictions to be ultimately limited rolling, and it becomes extremely difficult to perform an actual rolling. Particularly, the restrictions on the system such as rolling load and torque become problems upon the rolling of the maximum plate width. Conversely, upon the rolling with the minimum plate width, most of the restrictions are determined, for example, by the shape difficult to be restricted. Moreover, the rolling for obtaining the maximum production amount of the system is not necessarily required for all the rollings, and the above-described rolling is usually a little. Particularly, in a hot strip mill which is a thin plate rolling system for use in a hot processing, it is usual to perform a reversible rolling in a coarse rolling process and subsequently perform a finishing rolling in a tandem rolling mill. In this reversible coarse rolling mill, the rolling for obtaining the maximum production amount of the system is not necessarily required, and the rolling may be performed in a rolling time which is approximately the same as a finishing rolling time. When the rolling is performed with an allowance with respect to system ability, the method of setting the pass schedule according to the latter invention can be said to be inappropriate.

Moreover, in the invention disclosed in JP-A-51-72951, when there is a little change in the numerous restrictive conditions, the pass frequency is increased from the time of the change to gradually perform the adapted correction between the theoretical and estimated values. This method has a disadvantage that the change of the restrictive conditions cannot quickly be handled, and the rolling including errors is repeated many times.

SUMMARY OF THE INVENTION

Wherefore, an object of the present invention is to propose a guidance principle for determining a rolling pass schedule of each pass in a reversible rolling system, and to provide a reversible rolling method and a reversible rolling system in which the pass schedule is easily and rationally determined so that rolling can be performed on the basis of the guidance principle without depending on operational experiences.

To attain the above-described object, according to the present invention, there is provided a reversible rolling method for reciprocating and passing one steel strip several times forward and backward in a rolling mill to perform rolling, the method comprising the steps of: defining a function A using a rolling parameter which monotonically increases with respect to each pass draft amount; defining a function B using a rolling parameter which becomes larger as the pass becomes later; preparing the functions A and B so that a product $Q=A\times B$ of the functions A and B consequently forms a function substantially independent of a rolling speed; calculating the draft amount of each pass so that the function product $Q=A\times B$ has a substantially equal value in the respective passes; using the draft amount as a draft schedule; determining a rolling pass schedule on the basis of the draft schedule; and performing the rolling.

Therefore, by setting the value of the product Q to be substantially equal in each pass, the function A takes a value which becomes smaller as the pass becomes later by the action of the function B which becomes larger as the pass becomes later. Moreover, since the function A is in a relation of monotonic increase with respect to each pass draft amount, the draft amount becomes necessarily smaller as the pass becomes later. This corresponds to the draft schedule which follows the general idea in performing the reversible rolling. Additionally, in the present invention, the functions A and B are selected so that the product Q forms the function substantially independent of the rolling speed as a result. Therefore, each pass rolling speed and the draft schedule can freely be determined independently of each other, and the rolling pass schedule can be determined to easily and rationally perform the reversible rolling without depending on the experiences.

(2) In the above-described reversible rolling method (1), preferably, the function A includes at least one of each pass rolling torque and rolling load, or is the rolling torque or the rolling load itself. The function B is a function including at least one of a rolling material length on the outgoing or incoming side of each pass and an accumulated draft ratio, or is the rolling material length or the accumulated draft ratio itself.

Thereby, the function A is defined using the rolling parameter which is closely related with the draft schedule (draft amount), and the function B can be defined using the rolling parameter which becomes larger as the pass becomes later.

(3) In the above-described reversible rolling method (1) or (2), preferably when the number of all passes is N, the function Q of an i-th pass is Qi, and an evaluation function for i=1 to N passes in total of the rolling is represented by the following equation, the draft amount of each pass for setting the values of the function Q to be equal in the respective passes is calculated by obtaining the draft amount of each pass for providing the evaluation function with a minimum value.

$$E = \sum_{i=1}^{N-1} (Q_i - Q_{i+1})^2$$

Therefore, since the concrete calculating method for the above-described method (1) or (2) is provided, and the minimum point of the evaluation function E is easily searched in the function equation, the optimum rolling pass schedule can easily be calculated.

Moreover, to attain the above-described object, according to the present invention, thee is provided a reversible rolling method for reciprocating and passing one steel strip several times forward and backward in a rolling mill to perform rolling, the method comprising the steps of: preparing a function A including at least one of an average rolling power consumption or the average overload ratio itself, and monotonically increasing with respect to each pass draft amount; preparing a function B including a pass interval time and monotonically increasing with respect to the pass interval time, or being the pass interval time itself; and preparing the functions A and B so that a product Q=A×B of the functions A and B consequently forms a function substantially independent of a rolling speed; calculating the draft amount of each pass so that the function product Q=A×B has a substantially equal value in respective passes; using the draft amount as a draft schedule; determining a rolling pass schedule on the basis of the draft schedule; and performing the rolling.

Therefore, by setting the value of the product Q to be substantially equal in each pass, the function A takes a value which becomes smaller as the pass becomes later by the action of the function B which becomes larger as the pass becomes later. Moreover, since the function A is in a relation of monotonic increase with respect to each pass draft amount, the draft amount is necessarily reduced as the pass becomes later. This corresponds to the draft schedule which follows the general idea in performing the reversible rolling. Additionally, also in the present invention, the functions A and B are selected so that the product Q forms the function substantially independent of the rolling speed as a result. Therefore, each pass rolling speed and the draft schedule can freely be determined independently of each other, and the rolling pass schedule can be determined to easily and rationally perform the reversible rolling without depending on the experiences. Moreover, in the present invention, the draft schedule can be determined using the actual rolling parameters (e.g., the average rolling power consumption, the average overload ration, and the pass interval time).

Therefore, by setting the value of the product Q to be substantially equal in each pass, the function A takes a value which becomes smaller as the pass becomes later by the action of the function B which becomes larger as the pass becomes later. Moreover, since the function A is in a relation of monotonous increase with respect to each pass draft amount, the draft amount is necessarily reduced as the pass becomes later. This corresponds to the draft schedule which follows the general idea in performing the reversible rolling. Additionally, also in the present invention, the functions A and B are selected so that the product Q forms the function substantially independent of the rolling speed as a result. Therefore, each pass rolling speed and the draft schedule can freely be determined independently of each other, and the rolling pass schedule can be determined to easily and rationally perform the reversible rolling without depending on the experiences. Moreover, in the present invention, the draft schedule can be determined using the actual rolling parameters (e.g., the average rolling power consumption, the average overload ratio, and the pass interval time).

(5) In the above-described reversible rolling method (4), preferably when the number of all passes is N, the function A of an i-th pass is Ai, the function B is taken at a pass interval time t, and the function B of the i-th pass is taken at a pass interval time ti, and the evaluation function for i=1 to N passes in total of the rolling is represented by the following equation, the draft amount of each pass for setting the values of the function Q to be equal in the respective passes is calculated by obtaining the draft amount of each pass for providing the evaluation function with a minimum value.

$$E = \sum_{i=1}^{N-1} (Ai \cdot ti - A_{i+1} \cdot t_{i+1})^2$$

Therefore, since the concrete calculating method for the above-described method (4) is provided, and the minimum point of the evaluation function E is easily searched in the function equation, the optimum rolling pass schedule can be easily calculated.

(6) In either one of the above-described reversible rolling methods (1) to (5), preferably during the determination of the draft schedule, at least one of a draft ratio, a rolling torque, a rolling load, a rolling linear pressure, and a bite angle is considered as a restrictive condition, and the draft schedule is determined so as not to exceed their allowable maximum values.

Therefore, even when there are restrictive conditions, the optimum draft schedule can be determined.

(7) In either one of the above-described reversible rolling methods (1) to (6), preferably when the rolling pass schedule is determined on the basis of the draft schedule, each pass rolling speed is determined within a range of a designated maximum rolling speed not to exceed the designated stand overload ratio of the rolling mill under the condition that the average overload ratios of the passes are equalized.

Therefore, the reversible rolling by which the maximum production amount is obtained can be performed.

To attain the above-described object, according to the present invention, there is provided a reversible rolling system for reciprocating and passing one steel strip several times forward and backward in a rolling mill to perform rolling, the apparatus comprising: (a) plate thickness control means for controlling each pass draft amount of the rolling mill; (b) rolling speed control means for controlling each pass rolling speed of the rolling mill; and (c) control target value command means for defining a function A using a rolling parameter which monotonically increases with respect to each pass draft amount, defining a function B using a rolling parameter which becomes larger as the pass becomes later, using the functions A and B so that a product Q=A×B of the functions A and B consequently forms a function substantially independent of a rolling speed, calculating the draft amount of each pass so that the function product Q=A×B has a substantially equal value in respective passes to prepare a draft schedule, determining a rolling pass schedule on the basis of the draft schedule, and outputting a control target value to the plate thickness control means and the rolling speed control means.

Therefore, the reversible rolling system for concretely realizing the above-described reversible rolling method (1) is attained.

DETAILED DESCRIPTION OF THE PREFERRED EMBODIMENTS

An embodiment of the present invention will be described hereinafter with respect to the drawings.

Figure 1:
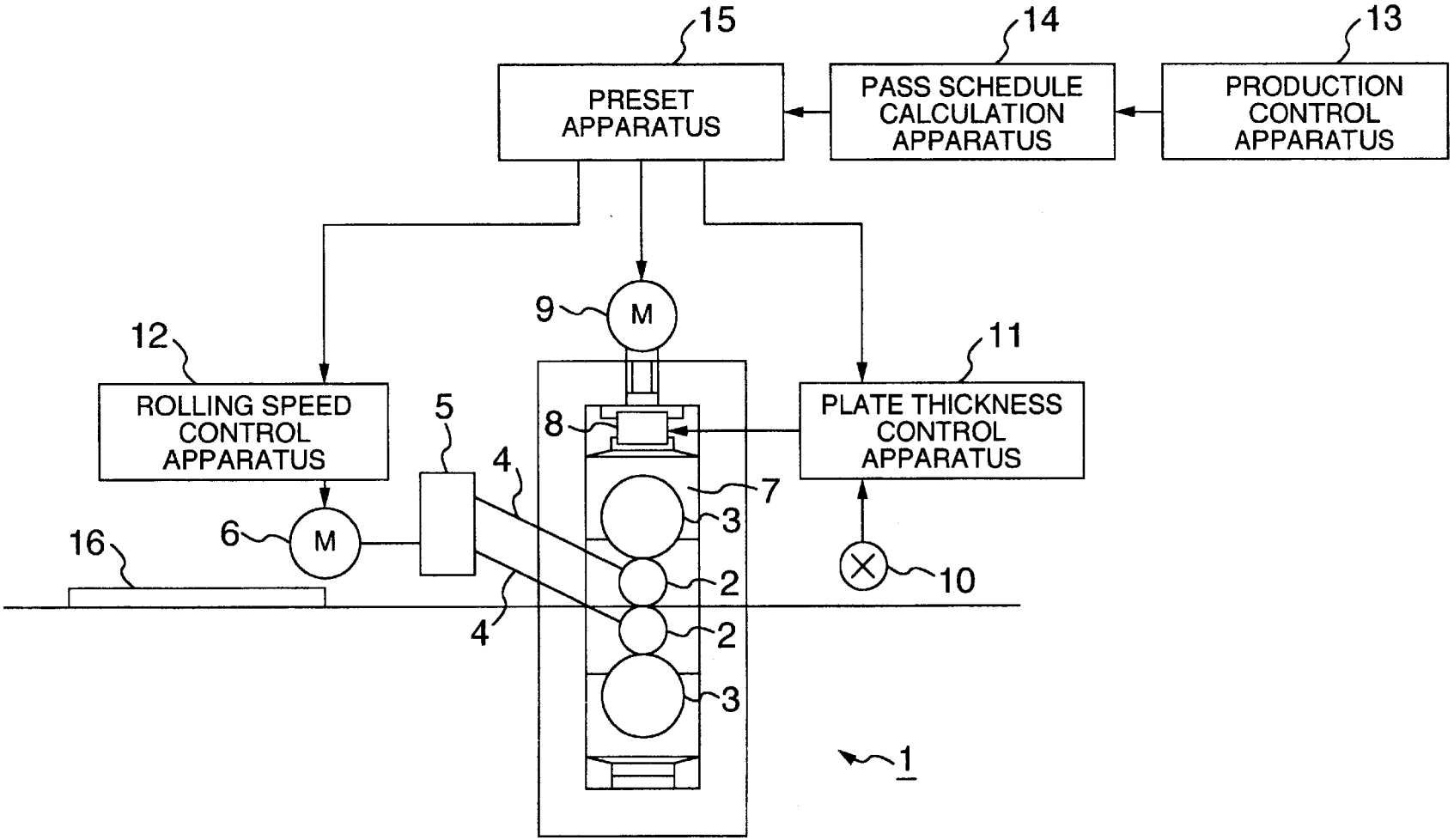
FIG. 1 is a schematic diagram showing the constitution of a hot reversible rolling system according to an embodiment of the present invention.

First, FIG. 1 is a schematic diagram showing the constitution of a hot reversible rolling system according to the embodiment of the present invention. In FIG. 1, a reversible rolling mill 1 is shown a so-called four-high rolling mill which includes working rolls 2 for directly rolling a rolling material 16, and large-diameter backup rolls 3 in contact with the working rolls 2. The working rolls 2 are driven by a mill motor 6 via spindles 4, a pinion stand 5, and the like. Moreover, disposed on a bearing box 7 of the upper backup roll 3 are a draft cylinder 8 as draft means for controlling a plate thickness during the rolling, and a draft motor 9 for adjusting an initial roll clearance. In the reversible coarse rolling mill of the hot reversible rolling system, since particularly the draft amount of the rolling material 16 increases, the roll clearance is frequently adjusted by the draft motor 9 in this manner. On the other hand, in a cold rolling mill, no draft motor 9 is usually disposed, and the initial roll clearance is directly set by the draft cylinder 8.

Moreover, the plate thickness during the rolling is controlled by controlling the position of the draft cylinder 8 by a plate thickness control apparatus 11 so that a difference between the plate thickness detected by a plate thickness detector 10 mounted on an rolling mill outgoing side and a target plate thickness becomes zero. Furthermore, the rolling speed is controlled by controlling the number of revolutions of the mill motor 6 by a rolling speed control apparatus 12 so that the rolling is performed with a given target speed.

In the rolling system, basic information such as quality, thickness, and width of the present rolling material are transmitted to a pass schedule calculation apparatus 14 from a production control apparatus 13 which is an upstream system. The pass schedule calculation apparatus 14 calculates the rolling pass schedule of the present rolling material on the basis of the information, and inputs a result to a preset apparatus 15. The preset apparatus 15 controls the draft motor 9 before actual rolling so as to perform the rolling with the given pass schedule, sets an appropriate initial roll clearance, and transmits the control target value to the plate thickness control apparatus 11 and rolling speed control apparatus 12 on the basis of the inputted pass schedule to complete preparations for the rolling. The plate thickness control and speed limitation in the subsequent actual rolling are performed by the plate thickness control apparatus 11 and rolling speed control apparatus 12 at moments in accordance with the control target value transmitted from the preset apparatus 15.

Furthermore, in the above-described reversible rolling system, the rolling pass schedule is determined by the pass schedule calculation apparatus 14 in accordance with the present invention. In the present invention, the rolling pass schedule can easily be set without depending on experiences, and the necessary restrictive conditions on the system can be avoided beforehand, so that the rolling operation can remarkably be facilitated. A method of determining/processing the rolling pass schedule by the pass schedule calculation apparatus 14 will be described hereinafter in detail.

Figure 2:
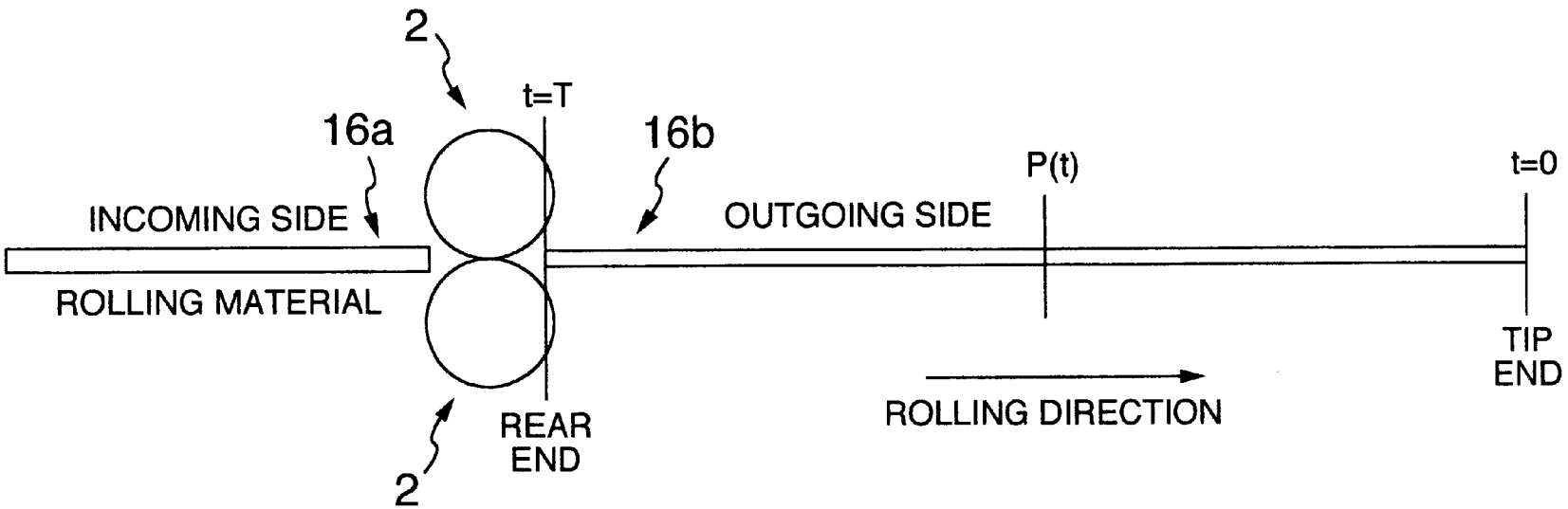
FIG. 2 is an explanatory drawing showing the meaning of term "average" in the present invention.

First, the meaning of the term "average" used in the following description is described with reference to FIG. 2 in examples of an average rolling power consumption and average overload ratio. FIG. 2 shows at an i-th pass (i-th rolling), by which an incoming-side rolling material 16*a* is rolled by the working rolls 2, and a state of 16*b* is obtained. Here, a moment when a tip end of the rolling material is engaged in the working rolls is used as a reference of time t, t=0 is set, and it is assumed that the rolling of the next pass is started after pass interval time t=T. A momentary rolling power consumption within the time is represented by P(t), and a motor capacity for the rolls is represented by M. When the symbols are used, a momentary overload ratio 0 is represented by O=P(t)/M, and an average rolling power consumption Pi and average overload ratio Oi at the i-th pass are usually represented as follows:

$$Pi = \frac{1}{T}\int_0^T P(t)\,dt \qquad (2)$$

$$Oi = \frac{1}{T}\int_0^T \frac{P(t)}{M}\,dt$$

Here, when a motor speed is equal to or less than an allowable base speed, it is preferable that the motor capacity M uses as an effective value a value with correction due to such motor speed added thereto. Moreover, the average rolling power consumption and average overload ratio may be processed by processing the above equation (1) in a discrete manner with time series. Particularly, Pi and Oi may be treated in an approximate manner, for example, by considering the average rolling power consumption on one point in the vicinity of substantially the center of the rolling material, or on a plurality of appropriate divided points.

Moreover, instead of the above equation (1), a so-called root mean square average may be considered.

$$Pi = \sqrt{\frac{1}{T}\int_0^T P(t)^2\,dt} \qquad (2)$$

$$Qi = \sqrt{\frac{1}{T}\int_0^T \left(\frac{P(t)}{M}\right)^2 dt}$$

Similarly to the above description, the above equation (2) may be processed in a discrete manner with time series. Since this also applies to other rolling parameters such as the rolling load and the rolling torque, the description is omitted.

However, it is preferable to regard the rolling power consumption P(t) as the power consumption acting on the motor. Therefore, in this case, the efficiency of a driving system, power necessary for rotating the motor forward and backward, and the like are included. Moreover, the pass interval time T used in the above equations (1), (2) may be used as a substantially net rolling time excluding a wasted time. Particularly, the RMS average overload ratio has a significant meaning as an index for measuring a motor overheat.

In the above definitions (1), (2), when the wasted time is zero and the power for rotating the motor forward and backward can be ignored and the rolling power is constant ($=P_0$) irrespective of time, $Pi=P_0$, $Oi=P_0/M$. In the following principle description, Pi, Oi is treated in this manner ($=P_0$, $P_0/M$).

The meanings and aims of the functions of the present invention (the functions A and B described in the paragraphs (1) and (4), and the evaluation functions Q and E described in the paragraphs (1), (3), (4), (5) in the summary of the invention) will next be described.

Generally, one of principles to be observed during the determining of the pass schedule in the reversible rolling mill is to set the draft amount in the first pass to be maximum, and to gradually decrease the draft amount each time the pass is repeated.

In this case, when the rolling speed in each pass is set so that the rolling power consumed in each pass is substantially the same, the rolling speed can be set to be high as the pass becomes later close to a final pass in which the length of the rolling material is long, and productivity is effectively enhanced. Moreover, as the rolling material becomes thinner, the shape control becomes more difficult. Also in this respect, it is preferable that the draft amounts of the later passes which are the finishing rolling are reduced, and the shape control can be easily performed. When the draft schedule is determined by the functions of the present invention, the above-described properties are naturally achieved as described later.

As a cause of the complicated determination of the pass schedule of the reversible rolling mill, each pass rolling speed set in the range of a certain restrictive condition and the draft schedule cannot freely be determined independently of each other. If these two factors can separately and independently be set, the determination of the pass schedule in the reversible rolling system can remarkably easily be performed. The functions of the present invention also match such purpose.

Details of the above description will be described hereinafter using equations. In the following description, the evaluation function is represented by the following equation as an example.

$$E = \sum_{i=1}^{N-1} (Ai \cdot ti - A_{i+1} \cdot t_{i+1})^2 \qquad (3)$$

Additionally, a rolling power consumption P is used as the rolling parameter of A in equation (3). Moreover, in an approximate manner, the rolling power consumption P can be regarded as being substantially proportional to the product of the rolling torque G and the rolling speed v, and is represented by P  Gv. Moreover, when the length of the rolling material on the outgoing side is L, and the pass interval time t is considered by a net rolling time which ignores the wasted time to be T, the pass interval time is represented by T=L/v. Therefore, the equation (3) is converted to the following equation (4), and a speed term (v) in the evaluation function E is eliminated on appearance.

$$PT\,(Gv)(L/v)=GL \qquad (4)$$

Therefore, it is understood that the influence of the rolling speed on the evaluation function of the present invention is small. This becomes clearer when the dimension of each rolling parameter is considered. For example, the dimension of the rolling power consumption P is represented, for example, by [kgm/s] as is known, and it is apparent that a speed dimension is included therein. When this is multiplied by a time dimension [s], the speed dimension is eliminated as a result. Therefore, it is obvious that the function may be constituted by $(PT)^2$ and the like. On the other hand, for example, when $P^{0.5}T$ and the like are considered, the speed dimension in the rolling power consumption P is not eliminated, which departs from the scope of the present invention. However, for example, $P^{1+\epsilon}T$ and the like are set, and small values such as 0.1 are set to $\epsilon$. This is substantially included in the present invention.

Moreover, the draft schedule for providing the evaluation function E of the above equation (3) with the minimum value is a schedule in which each pass PT in the above equation (4) becomes substantially equal. Furthermore, to set each pass PT of the equation (4) to be substantially equal means that the torque G is smaller as the passes become later and the draft amount is therefore distributed to be small as the passes become later in which the length of the rolling material is long. This matches the principle to be usually observed during the determining of the draft schedule of the above-described reversible rolling system.

This intrinsically means that the function A includes the rolling load, rolling torque and other rolling parameters closely related with the draft schedule, the function B includes the rolling material length, accumulated draft amount ratios to the present pass and other rolling parameters which necessarily become larger as the pass becomes later, the product of A and B constitutes the function Q for each pass, and the value of the product has a substantially equal value in each pass. In this manner, the draft schedule is obtained by the action of each parameter included in B so that the value of A becomes smaller as the pass becomes later. Morever, it is preferable that the function A constituted of the rolling parameter should have a property of monotonically increasing with respect to the draft amount in the practical use range in each pass. This is for making magnitudes relation between the value of the function A and the draft amount correspond to each other and for making them into one-to-one correspondence. With this, it becomes possible to unequivocally obtain the draft amount.

Conversely, for example, if the function A is constituted to have an extreme value with respect to the draft amount in the practical use range, it will become that two or more corresponding draft amounts exist with respect to one value of the function A has, and there is a disadvantage that the draft amount is not univocally determined.

Moreover, if the function B is taken to be a function which necessarily becomes smaller as the pass is later and the function A is determined to be a function which monotonically decreases with respect to the draft amount, it is obvious that the draft schedule will be one which is opposed to the general principle for the determination of the draft schedule of the above-described.

As described above, the method of using the evaluation function of the present invention to determine the draft schedule is one which easily conforms to the general principle for determining the pass schedule of the reversible rolling system. Additionally, since the rolling speed and the draft schedule can be handled substantially separately from each other, it can be understood that the determination of the draft schedule is remarkably facilitated without considering the influence of the rolling speed.

Moreover, to replace the method of determining the draft schedule particularly with the optimization problem to obtain the extreme value of the evaluation function results an effect to simplify taking-in of the necessary restrictive conditions in addition to making the determining method be one based on a very powerful guidance principle. This means that a safe and secure pass schedule can be determined.

For the means for actually solving the above-described optimization problem, a large number of general-purpose mathematical plan methods are announced, and that these can be utilized is one of the advantages of the present invention. However, the functions or the restrictive conditions of the present invention are usually nonlinear to the draft schedule or the rolling speed, and therefore, it is preferable to employ a technique of handling a nonlinear plan method. For example, "Numerical Analysis and FORTRAN" of the third version (Maruzen Co., Ltd.) discloses a simplex method and the like as an extreme value search method although in the case of no restrictive condition.

A method of determining each pass rolling speed will be described. First, after the draft schedule is determined in the above-described method, each pass rolling speed is determined on the basis of the schedule. When the draft schedule is determined, an initial rolling speed may have an appropriate value. For example, the same speed may be set in all the passes. This is because the evaluation function for use in the present invention is not largely influenced by the rolling speed as described above and therefore, the draft schedule does not largely vary by the set value of the rolling speed.

Here, in order to make the rolling speed be one which can maximize the production amount, each pass rolling speed may be set so that the average overload ratios (average load ratios to the motor) of the respective passes are equalized. However, as the restrictive condition of the rolling speed, the average RMS overload ratio (hereinafter referred to as the stand RMS) of the reversible rolling mill in time interval from the start of the rolling till the end of the rolling of all the passes is employed. Specifically, under the condition that the average overload ratios of the respective passes are equalized, the rolling speed is determined so as to use the stand RMS of the reversible rolling mill as a target stand RMS. It is obvious that only by setting the above-described target stand RMS to a system allowable upper limit value, the maximum production amount can be obtained.

In case that each pass rolling speed is determined in this manner, the average rolling power consumption of each pass becomes equal, but it is obvious from the above description that each pass rolling speed usually becomes faster as the pass becomes later. On the other hand, when the rolling speed with an allowance is set, it is obvious that it is sufficient to set the target stand RMS small. This also applies to the determination of the draft schedule, but the regulation with the restrictive condition value common to all the passes is unnecessary. It is natural that the setting can be performed by changing the restrictive condition value for each pass.

However, although the evaluation function for use in the present invention is not largely influenced by the rolling speed, in fact, the coefficient of friction of a roll bite section in the cold rolling system, or the rolling material temperature, deformation resistance or the like of the hot rolling system slightly changes. Therefore, when the rolling speed changes, the evaluation function is influenced by it and also changes. A process for correcting this variation comprises: first obtaining the draft schedule for the appropriately set rolling speed; and obtaining the rolling speed on the basis of the set draft schedule which is the above-described procedure and these steps may be repeatedly applied until both do not change any more.

Furthermore, the pass schedule obtained as described above does not need to be employed as the actual rolling pass schedule, and it is natural that some changes can further be added on the basis of the schedule. For example, in some systems, the rolling speed can only be selected from the predetermined speeds in a stepwise manner. In this case, it can be assumed that the set speed close to the speed obtained in the present method is selected.

Moreover, there is usually a wasteful time in which no rolling is performed from when the first rolling pass is finished until the next rolling pass is started. When this needs to be considered in the above-described equations (1) and (2), the rolling time T is replaced with a time T' with the wasteful time added thereto. In this case, naturally the rolling power consumption during the wasteful time-becomes P(t)=0. Particularly, the RMS average overload ratio has a significant meaning as the index of the motor thermal overload. When the rolling speed is regulated by this restriction, by considering the above-described wasteful time and obtaining more accurate motor thermal overload, an allowance for increasing the rolling speed can be found. Therefore, when the average rolling power consumption or the average overload ratio is used as the parameter of the evaluation function of the present invention, it is preferable to use the RMS average of the equation (2).

Furthermore, when the method of determining the pass schedule of the present invention is used, optimum number of rolling repetitions can easily be determined under the conditions of the present invention. Specifically, the method of determining the pass schedule of the present invention is used under various numbers of passes, the accumulated rolling time from the start till the end of the rolling is obtained, and the pass number at which the accumulated rolling time is minimized may be used as the number of rolling repetitions. When all the passes are determined by the respective rolling restrictive conditions, the minimum number of passes is obtained, and this is a schedule having the same meaning as in the above-described known example of JP-A-7-232205. However, this state does not necessarily give the minimum rolling time. Particularly in this case, the rolling load, rolling torque and the like become large. As a result, the rolling speed has to be reduced by the motor allowable power limitation. On the other hand, there is a case in which the number of passes are increased, each pass rolling gradually lightens, the rolling speed can be increased to the allowable upper limit, and the accumulated rolling time is a little as a result. However, when the number of passes is further increased, conversely the rolling time becomes long on account of the accumulation effect of the wasteful time present between the passes. Specifically, the accumulated rolling time has a minimum value with respect to the number of passes. The number of the passes to provide the accumulated rolling time with the minimum value is searched by solving the above-described optimization problem, and this number of the passes is used as the number of rolling repetitions.

An embodiment of using the determining method of the present invention to determine the pass schedule will be described hereinafter concretely.

In the following embodiment, an example of the hot reversible rolling mill will be described. The evaluation function E is assumed with the average overload ratio Oi and the pass interval time ti, and calculated in the following simplest equation.

$$E = \sum_{i=1}^{N-1} (Qi \cdot ti - Q_{i+1} \cdot t_{i+1})^2 : \text{MIN} \tag{5}$$

In the equation, $\phi j \geqq 0$, j=1 to M.

Here, MIN means that the extreme value (minimum value) is calculated, $\phi j \geqq 0$ indicates a j-th restrictive condition, and there are M conditions at maximum. Specifically, for example, when this is a restrictive condition equation in the rolling load of a k-th pass, the maximum rolling load is Fm, and the function for obtaining the rolling load of the k-th pass is Fk, $\phi j = Fm - Fk$ is represented.

When the draft is calculated using the above equation (5), Table 2 shows calculation results on the conditions of Table 1 in order to show that substantially the same draft schedule is obtained irrespective of the presumed initial rolling speed.

TABLE 1

| Number of passes | Rolling roll diameter | Motor capacity | Incoming-side plate thickness | Outgoing-side plate thickness | Plate width |
|---|---|---|---|---|---|
| 2 | 800 mm | 10000 kw | 100 nm | 35 rnm | l000 mm |

When the number of passes is twice, the rolling speed of the first pass is fixed at 100 m/min, and the speed of the second pass is changed between 100 m/min and 300 m/min, Table 2 shows the first pass outgoing-side plate thickness obtained from the rolling speeds and the conditions of Table 1 by the equation (5).

TABLE 2

| | | | | | |
|---|---|---|---|---|---|
| 2 pass speed (m/min) | 100 | 150 | 200 | 250 | 300 |
| 2 pass plate thickness (mm) | 57.0 | 56.7 | 56.4 | 56.2 | 56.0 |

As apparent from Table 2, even when the rolling speed is largely changed, the obtained draft schedule hardly changes. Therefore, it is understood that the draft schedule substantially independent of the rolling speed is obtained by determining the draft schedule by the equation (5).

Next shown is one example in which seven passes of rolling are repeated in the hot coarse rolling system. The rolling load is calculated by Sims equation, and the evaluation function is calculated by the equation (5) under the conditions of Table 3.

TABLE 3

| Number of passes | Rolling roll diameter | Motor capacity | Incoming side plate thickness | Outgoing-side plate thickness | Plate width |
|---|---|---|---|---|---|
| 7 | 1000 mm | 8000 kw | 220 mm | 30 mm | l200 mm |

Table 4 shows the calculation results of the plate thickness when no restrictive condition is considered, the wasteful time during the changeover of forward/backward rotation is zero, and the rolling speed has an appropriately inputted value.

TABLE 4

| No. | Plate thickness (mm) | Draft ratio (%) | Rolling speed (m/min) | Bite Angle (Deg) | Rolling load (tonf) | Rolling power (kw) | Over-load ratio (%) |
|---|---|---|---|---|---|---|---|
| 1 | 154.0 | 30.0 | 80.0 | 23.4 | 1278 | 6425 | 80.3 |
| 2 | 110.6 | 28.2 | 100.0 | 19.0 | 1130 | 5721 | 71.5 |
| 3 | 81.7 | 26.1 | 150.0 | 15.4 | 1041 | 6419 | 80.2 |
| 4 | 61.8 | 24.4 | 200.0 | 12.8 | 937 | 6383 | 79.8 |
| 5 | 47.7 | 22.8 | 250.0 | 10.8 | 875 | 6263 | 78.3 |
| 6 | 37.5 | 21.3 | 300.0 | 9.1 | 793 | 5781 | 72.3 |
| 7 | 30.0 | 20.0 | 300.0 | 7.9 | 762 | 4776 | 59.7 |

Additionally, the rolling power indicates a net rolling power, and the overload ratio is indicated in a simple ratio of the power and motor capacity. In this case, the average RMS overload ratio (hereinafter referred to as the stand RMS) of the rolling mill from the start of the rolling till the end of the rolling of all the passes was 74.1%.

Table 5 further shows the example in which the rolling speed is further determined on the same conditions as the above-described conditions. The conditions for determining the rolling speed are restricted so that the and RMS substantially reaches 100%. Specifically, the rolling speed is determined to obtain substantially 100% of the overload ratio. Moreover, the plate thickness is recalculated using the rolling speed by the equation (5).

TABLE 5

| No. | Plate thickness (mm) | Draft ratio (%) | Rolling speed (m/min) | Bite Angle (Deg) | Rolling load (tonf) | Rolling power (kw) | Over-load ratio (%) |
|---|---|---|---|---|---|---|---|
| 1 | 154.1 | 30.0 | 97.7 | 23.4 | 1308 | 8030 | 100.4 |
| 2 | 110.0 | 28.0 | 136.0 | 18.9 | 1162 | 7968 | 99.6 |
| 3 | 82.0 | 26.1 | 184.8 | 15.5 | 1056 | 8035 | 100.4 |
| 4 | 62.0 | 24.5 | 244.4 | 12.9 | 951 | 7948 | 99.4 |
| 5 | 47.8 | 22.9 | 316.9 | 10.8 | 885 | 8051 | 100.6 |
| 6 | 37.5 | 21.4 | 403.0 | 9.2 | 805 | 7918 | 99.0 |
| 7 | 30.0 | 20.1 | 500.0 | 7.9 | 767 | 8027 | 100.3 |

The overload ratio was substantially equally distributed in each stand, and the stand RMS was 99.9%.

On the other hand, the bite angle is limited to 18.0 degrees, the maximum rolling speed is limited to 300 m/min, the draft ratio of the final pass is 20% or less, the stand RMS is 80% as the restrictive condition of the rolling speed, each pass maximum allowable rolling speed is limited to 300 m/min, and Table 6 shows the calculation by the equation (5) under these conditions.

TABLE 6

| No. | Plate thickness (mm) | Draft ratio (%) | Rolling speed (m/min) | Bite Angle (Deg) | Rolling load (tonf) | Rolling power (kw) | Over-load ratio (%) |
|---|---|---|---|---|---|---|---|
| 1 | 180.8 | 17.8 | 153.9 | 18.0 | 843 | 6422 | 80.3 |
| 2 | 141.7 | 21.7 | 138.0 | 18.0 | 947 | 6397 | 80.0 |
| 3 | 102.5 | 27.6 | 119.8 | 18.0 | 1122 | 6451 | 80.6 |
| 4 | 70.7 | 31.0 | 127.2 | 16.2 | 1178 | 6368 | 79.6 |
| 5 | 50.5 | 28.5 | 177.1 | 12.9 | 1088 | 6501 | 81.3 |
| 6 | 37.5 | 25.8 | 300.0 | 10.3 | 977 | 7949 | 99.4 |
| 7 | 30.0 | 20.0 | 300.0 | 7.9 | 751 | 4708 | 58.8 |

In this example, the results of the 1st to 3rd passes are restricted by the bite angle limitation, the result of the 6th pass is restricted by the maximum rolling speed, and the result of the 7th pass is regulated by the maximum draft ratio and maximum rolling speed. The overload ratios of the respective passes other than the pass regulated by the rolling speed limitation are substantially equal, the stand RMS is 80.1% in this state, and the pass schedule substantially matching the target stand RMS is obtained.

Moreover, the rolling speeds of the 1st and 2nd passes are larger than that of the 3rd pass. This is because these passes are light rolling of which draft amounts are suppressed to be low by the bite angle limitation, so that the rolling speed can be set to be high. However, usually, it is considered as the general principle that the former the pass is, the lower the rolling speed is set to be. Therefore, the speed has to be determined by introducing an equation "the rolling speed of the previous pass ≦ the rolling speed of the subsequent pass" into the speed restrictive conditions, and such calculation is naturally possible.

As described above, according to the method of determining the pass schedule of the present invention, the schedule for easily avoiding the necessary restrictive conditions from the system ability can be obtained, and a secure rolling can be performed.

Moreover, the restrictive condition does not have to be necessarily set to the allowable upper limit value of the system, and it is natural that the safety value provided with an allowance can freely be set for each stand.

Furthermore, with respect to the evaluation function, even the employment of a separate system in the range not departing from the scope of the present invention is included in the range of the present invention. For example, as shown in the equation (5), in the present invention, the square sum of the difference in (average overload ratio)×(pass interval time) of two consecutive rolling passes is given. It is apparent that even when this is replaced with the power of the sum using another even-number index, such as the 4th power of the sum, the similar effect can be obtained. Moreover, by setting a simple average value of (average overload ratio)×(pass interval time) in the respective unrestricted stands to OTm, the following equation may be used.

$$E = \sum_{i=1}^{N} (Qi \cdot ti - OTm)^2$$

Furthermore, if this case does not stick to the reduction to the optimization problem, a direct processing is also possible as follows, although the processing of taking the restrictive conditions becomes intricate.

$$O_1t_1 = O_2t_2 = \ldots = O_nt_n$$

Moreover, in a strict meaning, it is usual that the plate width, rolling material length and the like are not exactly determined. For example, in the hot rolling, the plate width also spreads in the width direction during the rolling, that is, the width spread occurs. Accurately, the length of the rolling material are influenced by the width spread, but generally it is very difficult to accurately know this amount. However, when the above-described parameters are used in the present invention, the accurate value does not need to be used. For example, the value obtained by assuming that no width spread occurs may be used. However, if the parameter model equation for use is different, the obtained pass schedule naturally differs, but this may be judged by the result, and this is merely a matter of design when the present invention is actually applied.

According to the present invention, the pass schedule for performing the reversible rolling can easily and rationally be determined on the basis of the strong guidance principle without being based on experiences. Moreover, extremely large production amount can be obtained, and the pass schedule for facilitating the shape control and the like can easily be obtained.

What is claimed is:

1. A reversible rolling method for reciprocating and passing one steel strip several times forward and backward in a rolling mill to perform rolling, the method comprising the steps of:

preparing functions A and B so that a product Q of the functions A and B consequently forms a function independent of a rolling speed, said function A being defined by using a rolling parameter which monotonically increases with respect to draft amount of each pass, said function B being defined by using a rolling parameter which becomes larger with subsequent passes, and calculating the draft amount of each pass so that the product Q has an equal value in the respective passes, and using the draft amount as a draft schedule;

determining a rolling pass schedule on the basis of the draft schedule, and performing the rolling.

2. The reversible rolling method according to claim 1, wherein:

when determining said draft schedule, at least one of a draft ratio, a rolling torque, a rolling load, a rolling linear pressure and a bite angle is considered as a restrictive condition, and the draft schedule is determined so as not to exceed respective allowable maximum values.

3. The reversible rolling method according to claim 1 wherein:

when determining said rolling pass schedule on the basis of said draft schedule, rolling speed of each pass is determined within a range of a designated maximum rolling speed so as not to exceed the designated stand overload ratio of the rolling mill under the condition that the average overload ratio of each pass is equalized.

4. The reversible rolling method according to claim 2, wherein:

when determining said rolling pass schedule on the basis of said draft schedule, rolling speed of each pass is determined within a range of a designated maximum rolling speed so as not to exceed the designated stand overload ratio of the rolling mill under the condition that the average overload ratio of each pass is equalized.

5. A reversible rolling method for reciprocating and passing one steel strip several times forward and backward in a rolling mill to perform rolling, the method comprising the steps of:

preparing functions A and B so that a product Q of the functions A and B consequently forms a function independent of a rolling speed, said function A being defined by using a rolling parameter which monotonically increases with respect to draft amount of each pass, said function B being defined by using a rolling parameter which becomes larger with subsequent passes, and calculating the draft amount of each pass so that the product Q has an equal value in the respective passes, and using the draft amount as a draft schedule;

determining a rolling pass schedule on the basis of the draft schedule, and performing the rolling wherein:

said function A includes at least one of a rolling torque and a rolling load of each pass; and said function B is a function including at least one of a rolling material length on an outgoing side or an incoming side of each pass and an accumulated draft ratio.

6. The reversible rolling method according to claim 5, wherein:

when the number of all passes is N, the function Q of an i-th pass is Qi, and an evaluation function for i=1 to N passes in total of the rolling is represented by the following equation, the draft amount of each pass for setting the values of said function Q to be equal in the respective passes is calculated by obtaining the draft amount of each pass for providing the evaluation function with a minimum value:

$$E = \sum_{i=1}^{N} (Qi - Q_{i+1})^2.$$

7. The reversible rolling method according to claim 5, wherein:

when determining said draft schedule, at least one of a draft ratio a rolling torque, a rolling load, a rolling linear pressure and a bite angle is considered as a restrictive condition, and the draft schedule is determined so as not to exceed respective allowable maximum values.

8. The reversible rolling method according to claim 5, wherein:

when determining said rolling pass schedule on the basis of said draft schedule, rolling speed of each pass is determined within a range of a designated maximum rolling speed so as not to exceed the designated stand overload ratio of the rolling mill under the condition that the average overload ratio of each pass is equalized.

9. A reversible rolling method for reciprocating and passing one steel strip several times forward and backward in a rolling mill to perform rolling, the method comprising the steps of:

preparing functions A and B so that a product Q of the functions A and B consequently forms a function independent of a rolling speed, said function A being defined by using a rolling parameter which monotonically increases with respect to draft amount of each pass, said function B being defined by using a rolling parameter which becomes larger with subsequent passes, and calculating the draft amount of each pass so that the product Q has an equal value in the respective passes, and using the draft amount as a draft schedule;

determining a rolling pass schedule on the basis of the draft schedule, and performing the rolling wherein:

when the number of all passes is N, the function Q of an i-th pass is Qi, and an evaluation function for i=1 to N passes in total of the rolling is represented by the following equation, the draft amount of each pass for setting the values of said function Q to be equal in the respective passes is calculated by obtaining the draft amount of each pass for providing the evaluation function with a minimum value:

$$E = \sum_{i=1}^{N} (Qi - Q_{i+1})^2.$$

10. The reversible rolling method according to claim 9, wherein:

when determining said draft schedule, at least one of a draft ratio a rolling torque, a rolling load, a rolling linear pressure and a bite angle is considered as a restrictive condition, and the draft schedule is determined so as not to exceed respective allowable maximum values.

11. The reversible rolling method according to claim 9, wherein:

when determining said rolling pass schedule on the basis of said draft schedule, rolling speed of each pass is determined within a range of a designated maximum rolling speed so as not to exceed the designated stand overload ratio of the rolling mill under the condition that the average overload ratio of each pass is equalized.

12. A reversible rolling method for reciprocating and passing one steel strip several times forward and backward in a rolling mill to perform rolling, the method comprising the steps of:

preparing functions A and B so that a product Q of the functions A and B consequently forms a function independent of a rolling speed, said function A including at least one of an average rolling power consumption and an average overload ratio and being a function monotonically increasing with respect to each pass draft amount, said function B including a pass interval time and being a function monotonically increasing with respect to the pass interval time, or being the pass interval time itself;

calculating the draft amount of each pass so that the product Q has an equal value in the respective passes, and using the draft amount of a draft schedule;

determining a rolling pass schedule on the basis of the draft schedule, and performing the rolling.

13. The reversible rolling method according to claim 12, wherein:

when determining said draft schedule, at least one of a draft ratio a rolling torque, a rolling load, a rolling linear pressure and a bite angle is considered as a restrictive condition, and the draft schedule is determined so as not to exceed respective allowable maximum values.

14. The reversible rolling method according to claim 12, wherein:

when determining said rolling pass schedule on the basis of said draft schedule, rolling speed of each pass is determined within a range of a designated maximum rolling speed so as not to exceed the designated stand overload ratio of the rolling mill under the condition that the average overload ratio of each pass is equalized.

15. A reversible rolling method for reciprocating and passing one steel strip several times forward and backward in a rolling mill to perform rolling, the method comprising the steps of:

preparing functions A and B so that a product Q of the functions A and B consequently forms a function independent of a rolling speed, said function A including at least one of an average rolling power consumption and an average overload ratio and being a function monotonically increasing with respect to each pass draft amount, said function B including a pass interval time and being a function monotonically increasing with respect to the pass interval time, or being the pass interval time itself;

calculating the draft amount of each pass so that the product Q has an equal value in the respective passes, and using the draft amount of a draft schedule;

determining a rolling pass schedule on the basis of the draft schedule, and performing the rolling wherein:

when the number of all passes is N, the function A of an i-th pass is Ai, the function B is taken at a pass interval time t and the function B of an I-th pass is ti, and the evaluation function for i=1 to N passes in total of the rolling is represented by the following equation, the draft amount of each pass for setting the values of said function Q to be equal in the respective passes is calculated by obtaining the draft amount of each pass for providing the evaluation function with a minimum value:

$$E = \sum_{i=1}^{N} (Ai \cdot ti - A_{i+1} \cdot t_{i+1})^2.$$

16. The reversible rolling method according to claim 9, wherein:

when determining said draft schedule, at least one of a draft ratio a rolling torque, a rolling load, a rolling linear pressure and a bite angle is considered as a restrictive condition, and the draft schedule is determined so as not to exceed respective allowable maximum values.

17. The reversible rolling method according to claim 15, wherein:

when determining said rolling pass schedule on the basis of said draft schedule, rolling speed of each pass is determined within a range of a designated maximum rolling speed so as not to exceed the designated stand overload ratio of the rolling mill under the condition that the average overload ratio of each pass is equalized.

18. A reversible rolling system for reciprocating and passing one steel strip several times forward and backward in a rolling mill to perform rolling, the apparatus comprising:

plate thickness control means for controlling draft amount of each pass of said rolling mill;

rolling speed control means for controlling rolling speed of each pass of said rolling mill; and control target value command means for using functions A and B so that a product Q of the functions A and B consequently forms a function independent of a rolling speed, said function A being defined by using a rolling parameter which rolling speed control means for controlling rolling speed of each pass of said rolling mill; and control target value command means for using functions A and B so that a product Q of the functions A and B consequently forms a function independent of a rolling speed, said function A being defined by using a rolling parameter which monotonically increases with respect to draft amount of each pass, said function B being defined by using a rolling parameter which becomes larger with subsequent passes, and for calculating the draft amount of each pass so that the product Q has an equal value in the respective passes, and for using the draft amount as a draft schedule and for outputting a target control value to said rolling speed control means and said control target value command means on the basis of the draft schedule.

* * * * *

UNITED STATES PATENT AND TRADEMARK OFFICE

CERTIFICATE OF CORRECTION

PATENT NO. : 6,305,206 B1
DATED : October 23, 2001
INVENTOR(S) : Kobayashi

It is certified that error appears in the above-identified patent and that said Letters Patent is hereby corrected as shown below:

Title page,
Item [30], please amend as follows to correct the application number:

-- [30] Foreign Application Priority Data
Sep. 3, 1999 (JP) . . . . . 11-249929 --

Signed and Sealed this

Twenty-third Day of April, 2002

*Attest:*

*Attesting Officer*

JAMES E. ROGAN
*Director of the United States Patent and Trademark Office*